US005238509A

United States Patent [19]

Kusunoki

[11] Patent Number: 5,238,509

[45] Date of Patent: Aug. 24, 1993

[54] METHOD FOR CARRYING OUT A REMELTING/HARDENING TREATMENT

[75] Inventor: Hiroaki Kusunoki, Otake, Japan

[73] Assignee: Mazda Motor Corporation, Hiroshima, Japan

[21] Appl. No.: 756,572

[22] Filed: Sep. 9, 1991

[30] Foreign Application Priority Data

Sep. 27, 1990 [JP] Japan ..... 2-260114
Mar. 26, 1991 [JP] Japan ..... 3-84458

[51] Int. Cl.[5] ..... C21D 1/18
[52] U.S. Cl. ..... 148/511; 148/642
[58] Field of Search ..... 148/195, 511, 642; 75/10.12, 380

[56] References Cited

U.S. PATENT DOCUMENTS 4,312,685 1/1982 Riedl ..... 148/642
4,890,819 1/1990 Grand ..... 148/511

FOREIGN PATENT DOCUMENTS 60-211018 10/1985 Japan .
60-258420 12/1985 Japan .
60-258421 12/1985 Japan .
62-17131 1/1987 Japan .

OTHER PUBLICATIONS

"Temperature Controlled Flame Hardening," *Metallurgia*, Mar. 1952, pp. 135-136.

*Primary Examiner*—George Wyszomierski
*Attorney, Agent, or Firm*—Wenderoth, Lind & Ponack

[57] ABSTRACT

Remelting/hardening treatment is carried out for a work by a remelting/hardening treatment apparatus including a torch for heating the work. First, the work is firmly placed in position in the remelting/hardening treatment apparatus and a temperature of the work is then measured by a temperature detector. When the measured temperature is lower than a lower limit temperature of a predetermined or particular temperature range, a level of output from the torch is lowered and a part of the work other than a part thereof to be treated is then preheated by the torch. Thereafter, the part of the work to be treated is subjected to remelting and hardening with the aid of the torch. Consequently, production of unacceptable works can be prevented reliably, since remelting/hardening treatment is not carried out at all while the measured temperature is lower than the predetermined or particular temperature range. Alternatively, a preheating operation is performed by the torch while an insufficiently preheated work is placed in position in the remelting/hardening apparatus. After completion of the preheating operation, the work is subjected to remelting and hardening in the same manner as mentioned above.

16 Claims, 7 Drawing Sheets

METHOD FOR CARRYING OUT A REMELTING/HARDENING TREATMENT

BACKGROUND OF THE INVENTION

1. Field of the Invention

The present invention relates generally to a method for carrying out a remelting/hardening treatment. More particularly, the present invention relates to a method for carrying out such remelting/hardening treatment for a preheated work with the aid of a torch, wherein when the work is preheated at a lower temperature, a preheating operation is additionally performed for the work by using the torch and the remelting/hardening treatment is then carried out on the properly preheated work.

2. Description of the Prior Art

It is known in metallurgical technology to chill a metallic structure of a surface of a work or article made of cast iron or cast steel by allowing the surface of the work to be subjected to remelting and hardening, thereby to improve wear resistance and shock resistance of the work.

For example, a procedure for carrying out remelting/hardening treatment across the full width of a cam surface by rotating a preheated cam shaft while reciprocatively displacing a preheating torch in the axial direction of the cam shaft has been disclosed in an official gazette of Japanese Unexamined Patent Publication (Kokai) No. 60-258421.

According to such prior procedure, when the cam shaft is not preheated within a predetermined or particular temperature range before the cam shaft is subjected to the remelting/hardening treatment, it has been reported that there arises a malfunction such as surface crack or the like due to cooling at an excessively high speed after completion of a melting operation. For this reason, it is necessary to carefully control a preheating temperature (usually ranging from 150° to 400° C.) of the cam shaft which is to be subjected to remelting and hardening. Generally, a preheating station is arranged on the upstream side in a remelting/hardening treatment line along which cam surfaces on the cam shaft are successively subjected to remelting and hardening, at a plurality of treatment stations arranged on the downstream side of the remelting/hardening treatment line.

With respect to the foregoing remelting/hardening treatment line in which each cam shaft is successively subjected to remelting and hardening, there is a possibility that a temperature of the cam shaft is lowered during treatment in a plurality of treatment stations even through the cam shaft is correctly preheated to a predetermined temperature in the preheating station. In addition, there is a possibility that the temperature of the cam shaft is lowered due to unexpected line stoppage or similar malfunction.

Once the temperature of the cam shaft is lowered, there arises a problem that the remelting/hardening treatment will be carried out on the cam shaft that no longer is at a sufficiently high preheating temperature, in the event that the temperature of the cam shaft is not measured at each of the treatment stations. As a result, an unacceptable cam shaft may be produced undesirably.

On the other hand, in the event that the temperature of each cam is measured in the respective treatment station. If at any such station the preheating temperature is too low, the cam shaft may be returned to the preheating station. In such case, however, a conveying system extending across the remelting/hardening treatment line becomes complicated in structure. Also, many man-hours are consumed for returning insufficiently preheated cam shafts to the preheating station. Further, the remelting/hardening treatment is carried out at a low operational efficiency. Moreover, cam shafts can not smoothly be delivered to a subsequent step, i.e, an engine assembling step.

SUMMARY OF THE INVENTION

The present invention has been made in consideration of the aforementioned problems.

Therefore, an object of the present invention is to provide a method for carrying out a remelting/hardening treatment, wherein when a work is initially preheated at a lower temperature, it also is possible to perform an additional preheating operation by using a torch of the type preferably employable for the remelting operation.

To accomplish the above object, there is provided according to one aspect of the present invention a method of carrying out a remelting/hardening treatment for a work wherein the work is firmly placed in position in a remelting/hardening treatment apparatus including a torch for heating the work. A part of the work to be treated is then subjected to remelting and hardening with the aid of the torch. Prior to remelting, the temperature of the work is measured. If such measured temperature remains within a predetermined or particular temperature range, the work to be treated to the be subjected to remelting and hardening treatment. However, when the measured temperature is lower than the lower limit temperature of such predetermined or particular temperature range, the torch is used to additionally preheat a non-treated part of the work other than the part thereof to be subjected to the remelting/hardening treatment. Thereafter, the part of the work to be treated then is subjected to remelting and hardening.

With the method of the present invention, the additional preheating operation is performed on the non-treated part of the work while the torch is continuously displaced, and after completion of the additional preheating operation, the torch is continuously displaced from the non-treated part of the work to the part of the same to be treated.

In addition, with the method of the present invention, at least either of a level of output from the torch or an additional preheating treatment time is adequately determined based on the measured temperature before the additional preheating operation is performed.

An apparatus for carrying out the method of the invention comprises temperature measuring means for measuring a temperature of the work, work driving means for, when a temperature measured by the temperature measuring means remains within a predetermined or particular temperature range enabling, the part of the work to be treated to be subjected to remelting and hardening, but, when the measured temperature is lower than the lower limit temperature of the predetermined or particular temperature range ensuring that, a level of output from the torch is lowered and the part of the work to be treated is subjected to remelting and hardening only after a non-treated part of the work other than the part thereof to be treated is preheated by the torch; torch driving means, and controlling means for properly controlling the work driving means and the torch driving means.

With the method of the present invention, a remelting/hardening treatment is carried with the aid of the remelting/hardening treatment apparatus including a torch. A temperature of the work is first measured by the temperature measuring mean. When the measured temperature remains within the predetermined or particular temperature range, the part of the work to be treated is then subjected to remelting and hardening. Thus, production of an unacceptable product, e.g. a cam shaft, can be prevented reliably, since the remelting/hardening treatment is not carried out at all as long as the measured temperature of the work is lower than the predetermined or particular temperature range. Consequently, the part of the work to be treated is subjected to remelting and hardening only under conditions ensuring high quality.

When the measured temperature of the work is lower than the lower limit temperature of the predetermined or particular temperature range, a level of output from the torch is first lowered and the part of the work to be treated is then subjected to remelting and hardening only after the non-treated part of the work other than the part thereof to be treated is sufficiently preheated by the torch. Thus, since the remelting/hardening treatment and the additional preheating operation both are carried out by the same torch while the work is firmly held in position in the remelting/hardening apparatus, such malfunctions as reduced efficiency and a complicated structure of conveying system extending across the remelting/hardening treatment line can be avoided.

Further, since the non-treated part of the work is preheated while the torch is continuously displaced, such preheating can be achieved uniformly at a high operational efficiency. Moreover, an occurrence of incorrect local melting of the work can be prevented without fail. Additionally, since the torch is continuously displaced from the non-treated part of the work to the part thereof to be treated after completion of the preheating operation, the remelting/hardening treatment can be carried out at an improved operational efficiency.

In addition, since at least either of the level of output from the torch or the preheating treatment time is determined based on the measured temperature of the work before the preheating operation is performed, the preheating operation can be performed for the work while a preheating temperature remains within the predetermined or particular temperature range.

When the part of the work to be treated is subjected to remelting and hardening by actuating the torch, a temperature of the work is measured by the temperature measuring means. In addition, the controlling means controls operation for the work driving means and the torch driving means of the remelting/ hardening treatment apparatus in such a manner that when a temperature of the work measured by the temperature measuring means remains within the predetermined or particular temperature range, the part of the work to be treated is subjected to remelting and hardening, but when the measured temperature of the work is lower than the lower limit temperature of the predetermined or particular temperature range, the non-treated part of the work other than the part thereof to be treated is preheated by the torch, and thereafter, the part of the work to be treated is subjected to remelting and hardening.

Other objects, features and advantages of the present invention will become apparent from the following description which has been made in conjunction with the accompanying drawings.

BRIEF DESCRIPTION OF THE DRAWINGS

The present invention is illustrated in the following drawings in which.

DESCRIPTION OF THE PREFERRED EMBODIMENTS

Now, the present invention will be described in detail hereinafter with reference to the accompanying drawings which illustrate preferred embodiments of the present invention.

According to a first embodiment of the present invention, cams on direct valve driving type cam shafts to be installed in a four-cylinder engine mounted on an automotive vehicle are successively subjected to remelting and hardening along a remelting/hardening treatment line. Description will be made below with respect to a method and apparatus for carrying out remelting/hardening treatment while defining the direction of installation of the remelting/hardening line with reference to FIG. 1 to FIG. 3.

Figure 1:
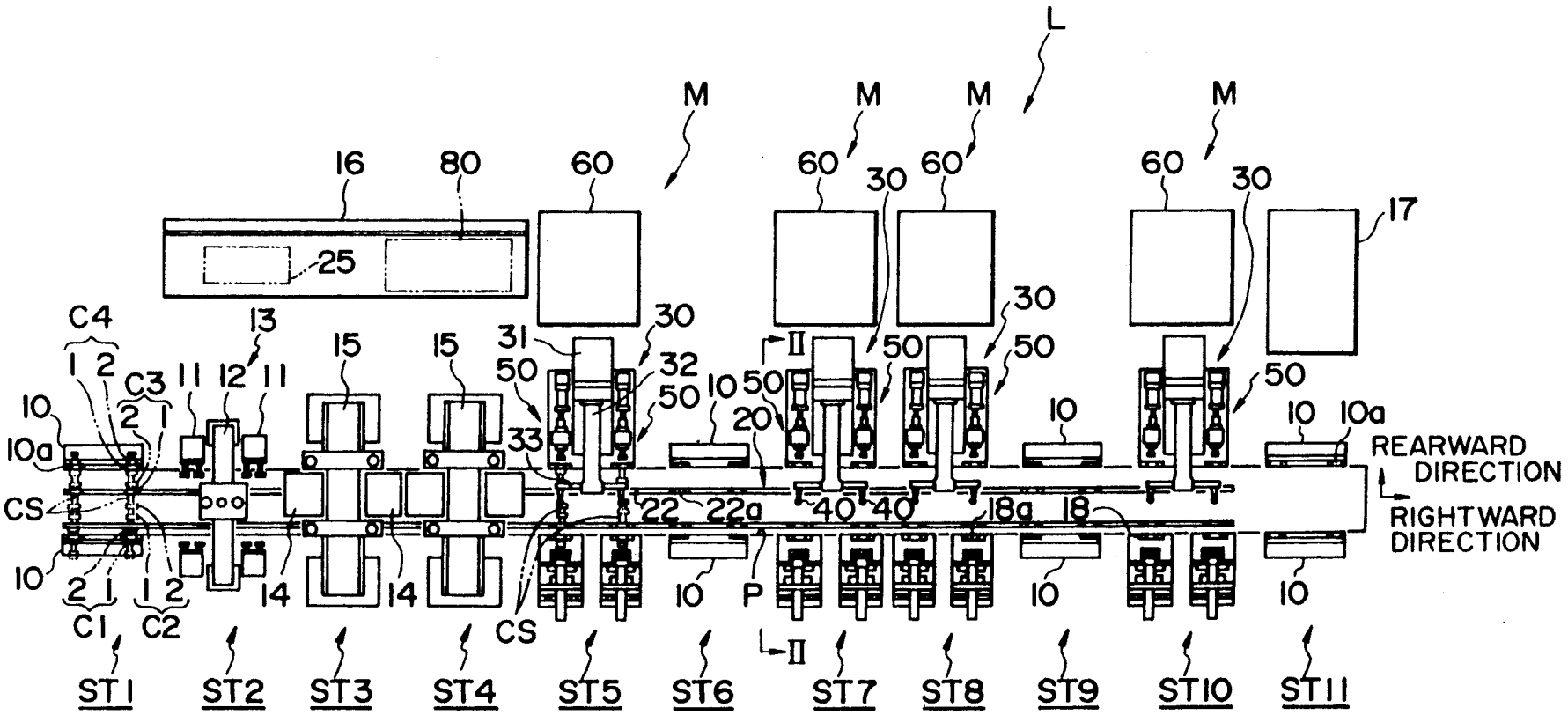
FIG. 1 is a plan view which schematically illustrates the structure of a remelting/hardening treatment line in accordance with a first embodiment of the present invention.
Figure 2:
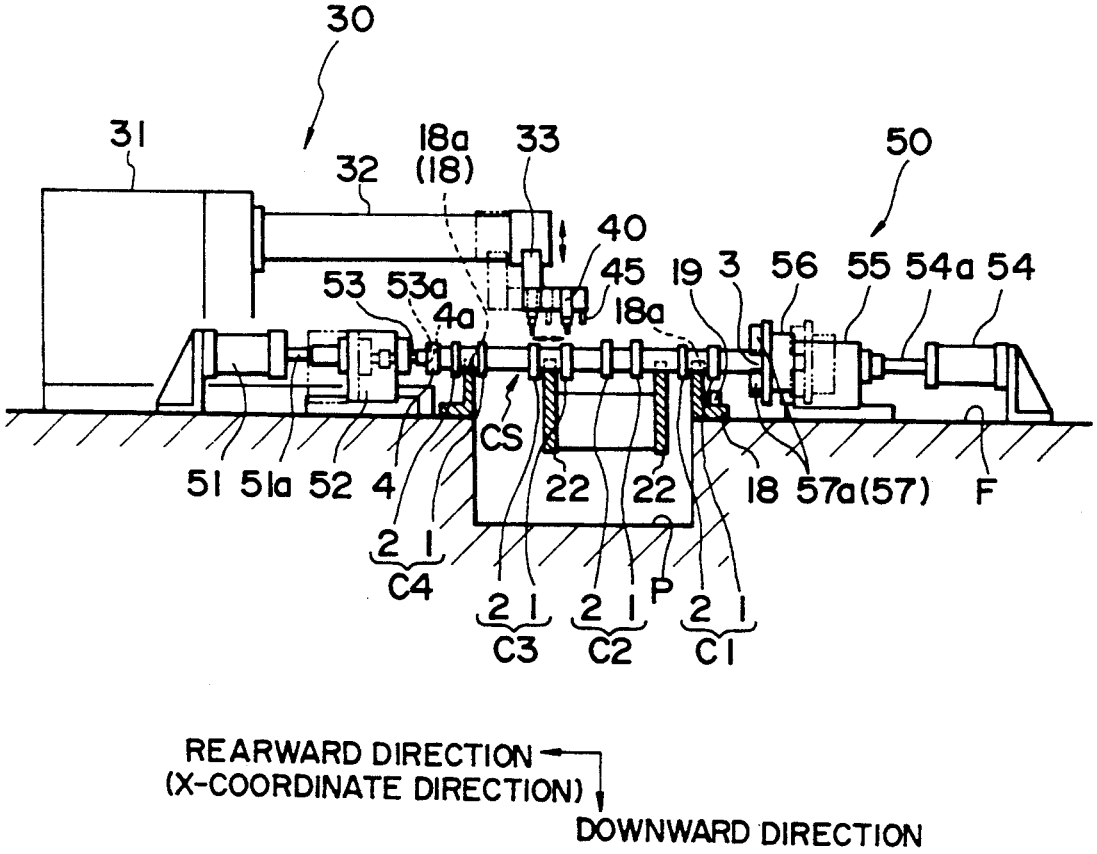
FIG. 2 is a side view of a remelting/hardening treatment apparatus arranged in the remelting/hardening treatment line in FIG. 1.

Referring to FIG. 1 and FIG. 2, a cam shaft is designated by reference character CS. Each cam shaft CS is made of ductile cast iron. As shown in the drawings, the cam shaft CS includes a first cam portion C1 to a fourth cam portion C4 each of which includes a suction or intake cam 1 for driving a suction or intake valve in each cylinder and an exhaust cam 2 for driving an exhaust valve in each cylinder of the four-cylinder engine. In addition, the cam shaft CS includes at least journal portions 3 and 4 at the foremost and rearmost ends thereof. An engagement hole **4*a* is formed on the rear end surface of the journal portion 4**.

Each of the suction cam 1 and the exhaust cam 2 has a cam surface 5, and a width of the cam surface 5 as measured in the axial direction of the cam shaft CS is dimensioned to be the same with respect to all the cam surfaces 5 on the cam shaft CS. A valve driving surface **5*b* on a nose portion of each of the cams 1 and 2 exclusive of a cylindrical surface 5*a* (i.e., a region extending from a melting operation start position M1** to a melting operation end position M2 located opposite to the melting operation start position M1 as represented by two-dot chain lines in FIG. 3; wherein it should be noted that the foregoing region corresponds to a region to be treated) is subjected to remelting and hardening across the full width of the cam surface 5. As is apparent from FIG. 3, edges 5c are formed around the cam surface 5 on the fore and rear sides of the each cam.

Next, description will be made below with respect to a remelting/hardening treatment line L and a remelting/ hardening treatment apparatus M which are installed for practicing a remelting/hardening treatment method of the present invention. Referring to FIG. 1 and FIG. 2 again, a cam shaft receiving station ST1, a vehicle type discriminating station ST2, a first preheating station ST3, a second preheating station ST4, a first treatment station ST5, a first waiting station ST6, a second treatment station ST7, a third treatment station ST8, a second waiting station ST9, a fourth treatment station ST10 and a cam shaft discharging station ST11 are successively arranged across the remelting/hardening treatment line L in such order as seen from the left-hand end of FIG. 1. In addition, a pit P is recessed across the stations ST1 to ST11 in the direction of installation of the remelting/hardening line L.

An opposed pair of work receiving members 10 are arranged with the pit P therebetween in each of the cam shaft receiving station ST1, the first and second waiting stations ST6 and ST9 and the cam shaft discharging station ST11. A vehicle type discriminating unit 13 composed of an opposed pair of cam shaft supporting mechanisms 11 and an opposed pair of vehicle type discriminating mechanisms 12 is arranged in the vehicle type discriminating station ST2. A preheating unit 15 including an opposed pair of preheaters 14 is arranged in each of the first and second preheating stations ST3 and ST4. In addition, a torch displacing/driving unit 30, an opposed pair of TIG torches 40 and an opposed pair of rotational cam shaft supporting units 50 are arranged in each of the first treatment station ST5, the second treatment station ST7, the third treatment station ST8 and the fourth treatment station ST10. It should be noted that a work receiving portion 10*a* is formed at each of the left-hand end and right-hand end of each work receiving member 10.

A lift and carrier type conveying unit 20 is arranged across the pit P so as to successively convey each cam shaft CS from the station ST1 to the station ST11.

The conveying unit 20 is composed of a driving mechanism (not shown) including a hydraulic cylinder and associated components, carriers 22 or the like, and operation of the conveying unit 20 is controlled by a conveyance controller 25 installed on a control board 16 located rearwardly of the cam shaft receiving station ST1. Each carrier 22 is cyclically driven by a predetermined distance by the driving mechanism arranged in each of the stations ST1 to ST11, not only in the vertical direction but also in the transverse direction of the remelting/hardening treatment line L. It should be added that a pair of cam shaft receiving portions 22*a* are formed on the upper surface of each carrier 22 with a predetermined distance therebetween.

First, two cam shafts CS are received from a cam shaft production line (not shown) in the cam shaft receiving station ST1 from above by actuating an automatic loader (not shown). As shown by two-dot chain lines in FIG. 1, each cam shaft CS is placed on work receiving portions 10*a* located at opposite ends of the work receiving member 10 in the longitudinal direction of the remelting/hardening treatment line L. After completion of the loading operation, the two cam shafts CS received in the cam shaft receiving station ST1 are then successively conveyed from spacing by actuating each carrier 22.

When the cam shafts CS are conveyed to the vehicle type discriminating station ST2, they are supported by the supporting mechanisms 11 and then rotationally driven about their axial axes so that they are placed at a reference phase position (e.g., a position where the nose portion of the suction cam 1 on a first cam portion C1 is oriented in the downward direction). Then, while the foregoing state is maintained, a specific vehicle type discriminating mark formed on the cam shaft CS is detected by the discriminating mechanism 12. Next, after the cam shaft CS is preheated for a predetermined period of time by a preheater 14, a working temperature of which is set to a predetermined temperature (e.g., 200° C.), in the first preheating station ST3, the cam shaft CS is heated up to an elevated temperature for a predetermined period of time by another preheater 14, a working temperature of which is set to a predetermined temperature (e.g., 400° C.), in the second preheating station ST4. Subsequently, while the temperature of the cam shaft CS remains within a preset temperature range (e.g., 150° to 400° C.) in the first treatment station ST5, the cam shaft CS is rotationally driven by a rotational supporting unit 50, and the suction cam 1 and the exhaust cam 2 on the first cam portion C1 are then subjected to remelting and hardening with the aid of a TIG torch 40 in the first treatment station ST5. Thereafter, suction cams 1 and exhaust cams 2 on a second cam portion C2, a third cam portion C3 and a fourth cam portion C4 are subjected to remelting and hardening in the same manner as mentioned above at the second treatment station ST7, the third treatment station ST8 and the fourth treatment station ST10.

After completion of remelting and hardening treatments for the eight cams 1 and 2 in the above-described manner, the cam shaft CS is conveyed from the cam shaft discharging station ST11 to an engine assembling line (not shown). It should be noted that the first and second waiting stations ST6 and ST9 are arranged in the remelting/hardening treatment line L for the purpose of temporarily holding the cam shaft CS in a waiting state in the case of an occurrence of a malfunction such as line stop page or the like.

Next, description will be made below with respect to the remelting/hardening treatment apparatus arranged in each of the treatment stations ST5, ST7, ST8 and ST10. In detail, as shown in FIG. 1 to FIG. 4, each remelting/ hardening treatment apparatus M includes a torch displacing/driving unit 30, an opposed pair of TIG torches 40 mounted on the torch displacing/driving unit 30, an opposed pair of rotational supporting units 50 and a torch power supply source unit 60. On the other hand, the control board 16 is provided with a control unit 80 for properly controlling four sets of remelting/hardening treatment apparatuses M. In FIG. 1, reference numeral 17 designates a hydraulic pressure supplying unit.

Figure 3:
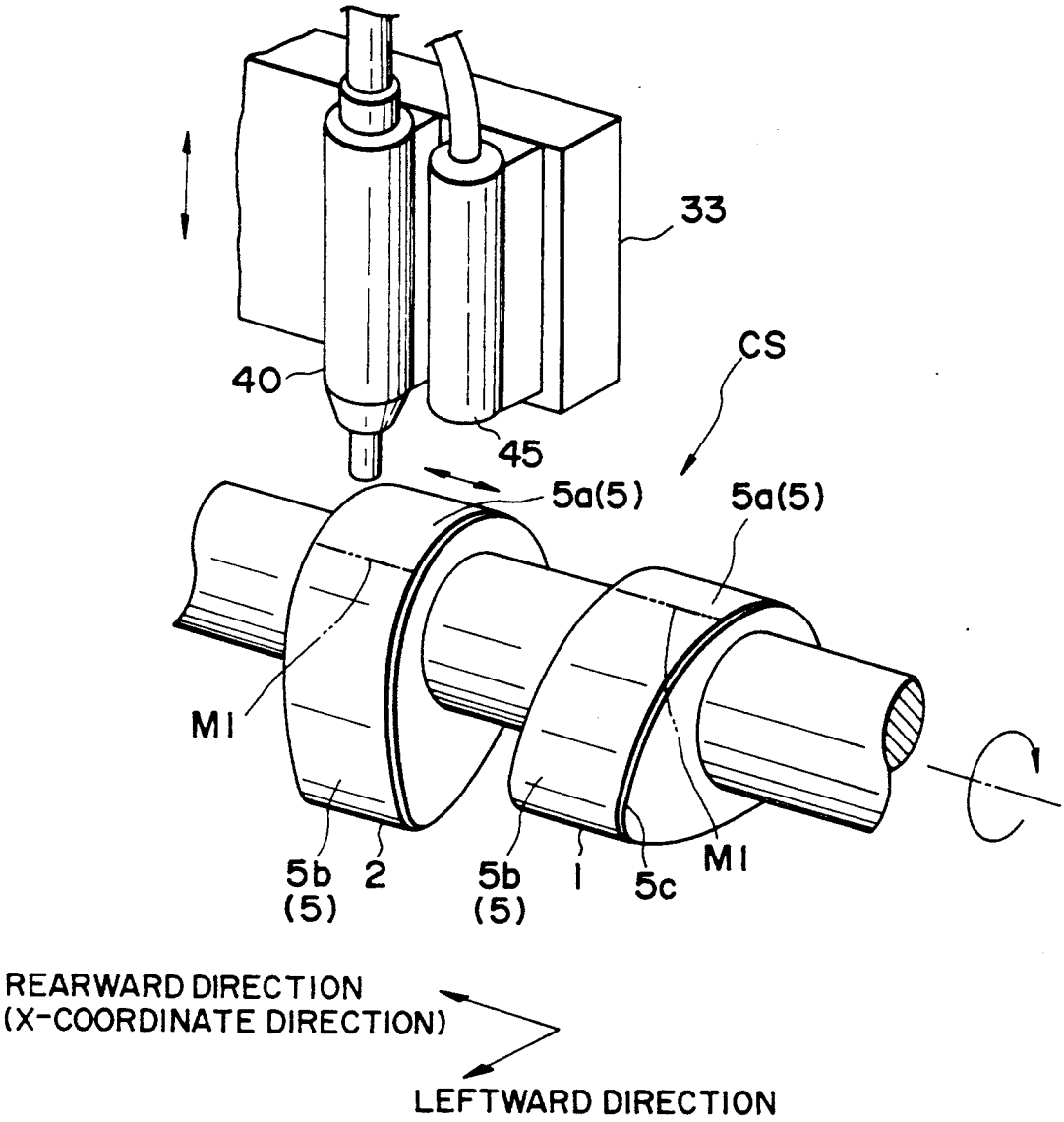
FIG. 3 is a perspective view which illustrates a cam shaft, a torch and associated components.
Figure 4:
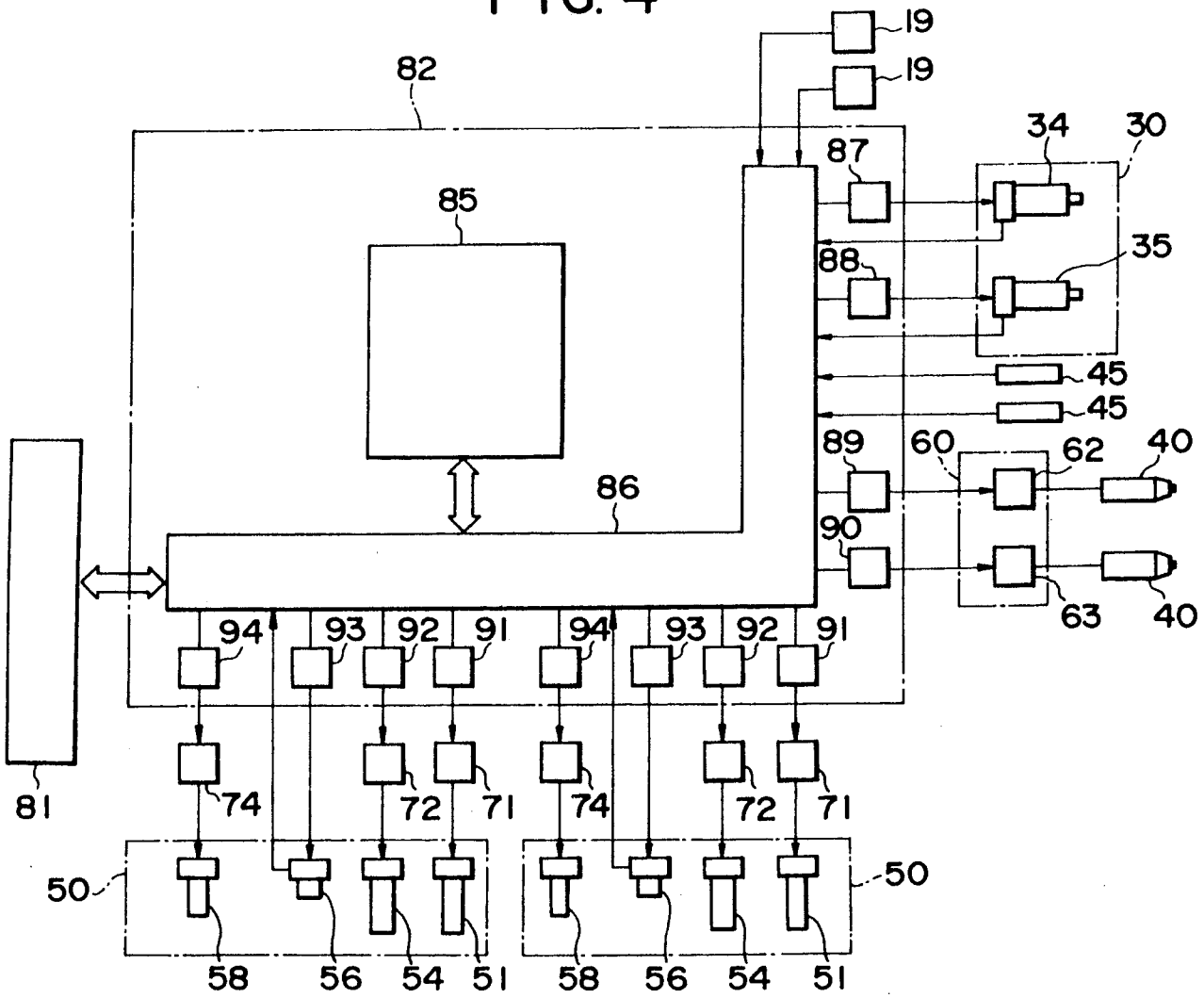
FIG. 4 is a block diagram which illustrates the whole structure of a control system.

The torch displacing/driving unit 30 includes a housing 31 and an arm 32 projecting forward from the housing 31. The housing 31 is provided, as shown in FIG. 4, with a servomotor 34 for reciprocatively driving the arm 32 in the forward/ rearward direction (X-coordinate direction) and another servomotor 35 for reciprocatively driving the arm 32 in the upward/downward direction (Z-coordinate direction). A supporting member 33 extending in the leftward/rightward direction is mounted at the foremost end of the arm 32. As shown in FIG. 3, a TIG torch 40 and a temperature detector 45 for detecting a temperature of the cam shaft CS are arranged at each of the left-hand end and the right-hand end of the supporting member 33 so that valve driving surfaces 5b of the suction cams 1 and the exhaust cams 2 on the two cam shafts CS arranged on the right-hand and left-hand sides of the remelting/hardening treatment line L are successively subjected to remelting and hardening. It should be added that an infrared ray emitting type thermometer having a thermally deposited thermopile incorporated therein as a detecting element is preferably employable for the temperature detector 45.

As shown in FIG. 2, the rotational supporting unit 50 is composed of a hydraulic cylinder 51 arranged rearwardly of the pit P, a support shaft member 53 operatively connected to a rod 51a of the hydraulic cylinder 51 via a guide member 52, another hydraulic cylinder 54 arranged forwardly of the pit P while assuming a position opposite to the hydraulic cylinder 51, a servomotor 56 operatively connected to a rod 54a of the hydraulic cylinder 54 via a guide member 55 and a holder 57 mounted at the foremost end of an output shaft of the servomotor 56.

The support shaft member 53, the servomotor 56 and the holder 57 are arranged in such a manner that they can be shifted as desired between advanced positions represented by solid lines in FIG. 2 and retracted positions represented by two-dot chain lines in FIG. 2. The holder 57 includes three sets of holding portions 57a each adapted to selectively assume one of a holding position and a non-holding position as desired by actuating a hydraulic cylinder 58 (see FIG. 4). It should be noted that a pin 53a adapted to be engaged with engagement hole 4a of the cam shaft CS is disposed at the foremost end of the support shaft member 53.

The advanced position of the holder 57 is shifted to the retracted position of the same and vice versa by driving the rod 54a of the hydraulic cylinder 54 with a full stroke in the forward direction or in the rearward direction. The advanced position of the holder 57 is set to be a reference point of the X-coordinate direction.

When the cam shaft CS is conveyed to each of the treatment stations ST5, ST7, ST8 and ST10, the support shaft member 53 and the holder 57 in each of the treatment stations ST5, ST7, ST8 and ST10 are displaced to their retracted positions, and the working position of the holder 57 is shifted to its non-holding position. In addition, when the cam shaft CS is placed at a predetermined position in each of the treatment stations ST5, ST7, ST8 and ST10, right-hand and left-hand TIG torches 40 in each of the aforementioned stations are located not only at the central positions of the corresponding cams and 2 as seen in the direction of their width but also on their center lines extending through the axis line of the cam shaft CS in the upward/downward direction (Z-coordinate direction). Incidentally, the fact that the cam shaft CS is properly placed at a predetermined position in each of the treatment stations ST5, ST7, ST8 and ST10 represents the operative state that the foremost end surface of a journal portion 3 is held by the holder 57 while it is located at a reference position, and moreover, a journal portion 4 is supported by the support shaft member 53 via the engagement hole 4a.

Referring to FIG. 1 and FIG. 2 again, to assure that the cam shaft CS which has been conveyed with the aid of each carrier 22 is properly placed in the above-described manner, work receiving members 18 each including a work receiving portion 18a are arranged at opposite sides of the pit P on the fore side of the support shaft member 53 as well as on the rear side of the holder 57. The work receiving member 18 located on the holder 57 side is equipped with a non-contact type detecting switch 19 for detecting the cam shaft CS.

As shown in FIG. 4, the torch power supply source unit 60 includes electric current adjusting portions 62 and 63 for properly adjusting an intensity of arc electric current to be fed to each of the left-hand and right-hand TIG torches 40.

Additionally, the control unit 80 is essentially composed of a host controller 81 and four sub-controllers 82 (only one shown in FIG. 4) arranged corresponding to the treatment stations ST5, ST7, ST8 and ST10.

The host controller 81 normally monitors the operative state of the remelting/hardening treatment line L. In detail, the host controller 81 comprehensively controls operations of the vehicle type discriminating unit 13, the preheating unit 15, the remelting/hardening treatment apparatus M and the conveying unit 20 arranged in each of the treatment stations ST5, ST7, ST8 and ST10 in order that the remelting/hardening treatment line L is operated while maintaining an optimum state corresponding to, e.g., a quantity of the cam shafts CS conveyed in the remelting/hardening treatment line L, a type of employed vehicle and the present treatment state in each of the aforementioned stations. In addition, various kinds of data are input into the host controller 81 from each of the vehicle type discriminating unit 13, the preheating unit 15 and the remelting/hardening treatment apparatus M in each of the aforementioned stations.

Each of the sub-controllers 82 controllably drives the remelting/hardening treatment apparatus M in response to a control signal transmitted from the host controller 81. As shown in FIG. 4, each sub-controller 82 includes a microcomputer 85 composed of CPU, RAM, ROM and other components as well as an input/output interface 86. A control program for remelting/hardening treatments to be described later is previously stored in the ROM of the microcomputer 85. Drivers 87 and 88 for the servomotors 34 and 35 for the torch displacing/driving unit 30, drivers 91, 92 and 94 for solenoid valves 71, 72 and 74 adapted to control an intensity of hydraulic pressure to be supplied to the hydraulic cylinders 51 and 54 for the left-hand and right-hand rotational supporting units 50 and a driver 93 for the left-hand and right-hand servomotors 56 are electrically connected to the input/output interface 86. In addition, detection signals are input into the microcomputer 85 from the detection switch 19 and the temperature detector 45 via the input/output interface 86. It should be noted that the foregoing program for remelting/hardening treatment includes a plurality of processing routines each differing depending on a type of employed vehicle, and moreover, the control program is a program employable for realizing a remelting/hardening treating method to be described below wherein this program is previously stored in the microcomputer 85.

Next, the present invention will be described below with respect to an example concerned with a method of carrying out remelting/hardening treatment for the suction cam 1 on the first cam portion C1 of each of the cam shafts CS in the first treatment station ST5 wherein one set of the cam shafts CS is normally composed of two cam shafts.

First, when a cam shaft CS is conveyed to the first treatment station ST5, conveyance of the cam shaft CS is detected by the detecting switch 19. Subsequently, the cylinders 51 and 54 are driven so as to allow the rods 51*a* and 54*a* to be displaced in the forward direction, and at the same time, the cylinder 51 is driven such that the cam shaft CS is firmly placed at a predetermined position in the foregoing station while it is held by the holding portion 57*a* of the holder 57.

Figure 5:
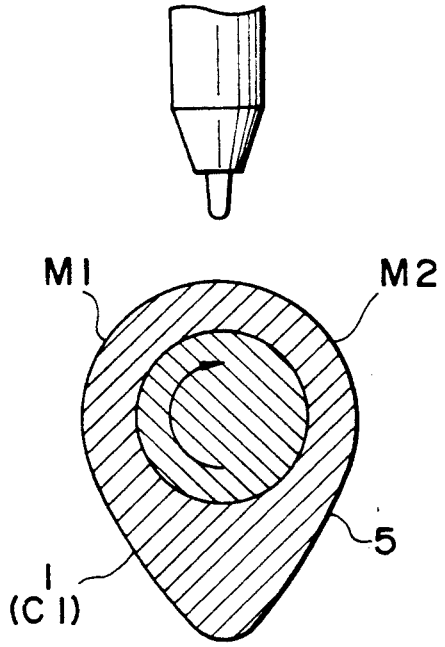
FIG. 5 is a cross-sectional view of a suction cam on a first cam portion of the cam shaft which is placed in position in the remelting/hardening treatment apparatus shown in FIG. 2.

Next, the servomotor 34 is controllably driven so as to allow the torch 40 to be displaced to a center of the cam surface 5 of the cam 1 as seen in the direction of its width. In addition, as the servomotor 35 is controllably driven, a height of the torch 40 is properly determined such that the torch 40 is located at a predetermined position above the center axis of the cam shaft CS. This positional state is illustrated in FIG. 5.

Next, the present temperature of the cam shaft CS is measured by the temperature detector 45. When it has been found from such measurement that the measured temperature T remains within a predetermined or particular temperature range (e.g., 150° to 400° C.), the servomotor 56 is rotationally driven so that the cam shaft CS is rotated by a predetermined angle (about 55 degrees) in the direction indicated by the arrow in FIG. 5, whereby the torch 40 is located opposite to a melting operation start position M1.

Figure 6:
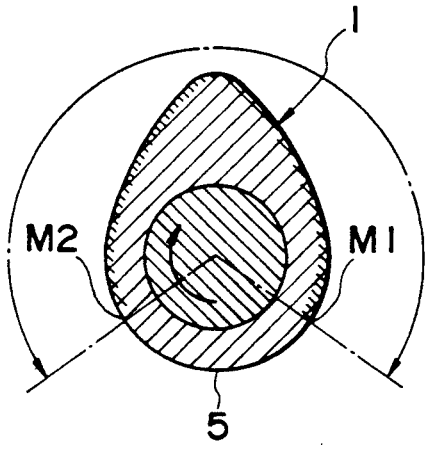
FIG. 6 to FIG. 8 are cross-sectional views of cam shafts and cams, particularly illustrating a remelting/ hardening treatment range and a preheating treatment range.

Next, while the servomotor 56 is rotated at a very slow speed in the same direction, the torch 40 is fed with a predetermined intensity of driving electricity for remelting a part of the cam surface 5, and at the same time, the servomotor 34 is controllably driven so as to allow the torch 40 to be reciprocatively displaced at a slow speed in the axial direction by a distance corresponding to the full width of the cam surface 5. Thus, a remelting/hardening treatment is carried out for the cam surface 5. During this treatment, the servomotor 35 is controllably driven such that the height of the torch 40 as measured from the cam surface 5 is kept constant. As shown in FIG. 6, the surface region ranging from the melting operation start position Mi to the melting operation end position M2 is subjected to remelting and hardening for about 40 minutes. After completion of the foregoing treatment, driving of the torch 40 is interrupted. In addition, rotation of the servomotor 34 is interrupted when the torch 40 reaches the position corresponding to the center of the width of the cam surface 5. Subsequently, rotational operation of the servomotor 56 is shifted to rotation at a high speed, and when the cam shaft CS reaches the operative state as shown in FIG. 5, driving of the servomotor 56 is interrupted.

On completion of the aforementioned remelting/-hardening treatment, the surface layer of the cam surface 5 remaining within the range from the melting operation start position M1 to the melting operation end position M2 is chilled, resulting in a metallurgical structure having excellent wear resistance and shock resistance in a surface layer of the cam surface 5.

Figure 7:
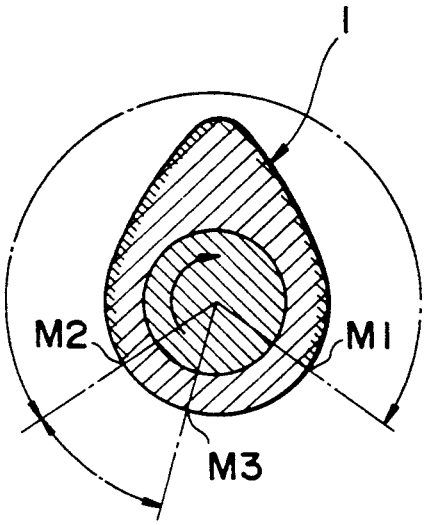

When the above measured temperature T is not within the predetermined or particular range, but rather is in a range of 100° C.≦T≦150° C., then prior to the remelting/hardening treatment, a preheating operation is performed on the cam surface 5 within a range or portion there of from melting operation end position M2 (i.e., a preheating operation start position) to a preheating operation end position M3 as shown in FIG. 7.

When such preheating operation is performed, first, the servomotor 56 is controllably driven so that the cam shaft CS is rotated until the preheating operation start position M2 is located opposite to the torch 40. Subsequently, rotational operation of the servomotor 56 is shifted to rotation at a very slow speed and the torch 40 is then fed with driving electricity for performing a preheating operation, the intensity of which corresponds to about 20 to 50% of the electricity required for a remelting operation. In addition, the torch 40 is reciprocatively displaced in the axial direction by a distance corresponding to the full width of the cam surface 5 by driving the servomotor 34. In this case, since the measured temperature or particular is slightly lower than the lower limit of the predetermined temperature range (150° C.) for carrying out the remelting/hardening treatment, the preheating treatment range from the preheating operation start position M2 to the preheating operation end position M3 is limited to a narrow range corresponding to an angle of about 40 degrees. Thus, the entire region of the cam 1 on the cam shaft CS inclusive of its peripheral part is heated by such preheating to the predetermined or particular temperature range of 150° to 400° C. necessary for performing remelting operation. It should be noted that the reason that the electricity is determined to have such a low intensity as mentioned above is to prevent the cam surface 5 from being made molten by the preheating operation. After completion of the preheating operation within the range from the preheating operation start position M2 to the preheating operation end position M3, driving of the torch 40 is interrupted. Additionally, when the torch 40 is located at a position corresponding to the center of the width of the cam surface 5 driving of the servomotor 34 is interrupted, and at the same time, rotational operation of the servomotor 56 is shifted to rotation at a high speed, whereby the cam shaft CS is rotationally driven until the melting operation start position M1 is located opposite to the torch 40.

Then, the above discussed remelting/hardening treatment of the cam surface 5 within the range from the melting operation start position M1 to the melting operation end position M2 is carried out in the same manner as mentioned above.

Figure 8:
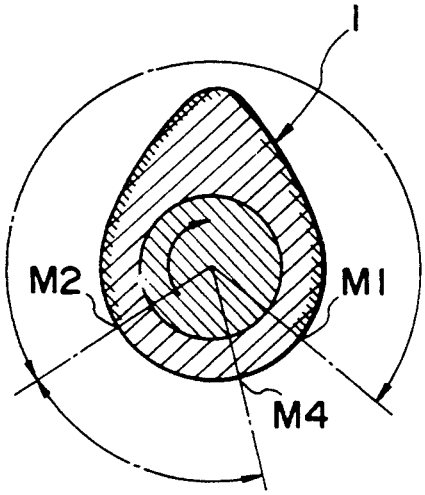

When the above measured temperature T is lower than 100° C., first, i.e. prior to the remelting treatment, a preheating operation is performed on the cam surface 5 within a range or portion thereof from melting operation stop position M2 (i.e., a preheating operation start position) to a preheating operation end position M4 as shown in FIG. 8.

This preheating operation is performed in the same manner as the aforementioned preheating operation. To this end, the intensity of driving electricity to be fed to the torch 40 is determined in the same manner as mentioned above. However, since the measured temperature T is substantially lower than the lower limit of the predetermined or particular temperature range (150° C.) required for carrying out the remelting/hardening treatment, the range of this preheating treatment from the preheating operation start position M2 to the preheating operation end position M4 is determined to be greater, i.e. to an angle of about 65 degrees. Thus, the entire region of the cam 1 on the cam shaft CS inclusive of its peripheral part is heated by such preheating to the range predetermined or particular of 150° to 400° C. necessary for performing remelting.

Subsequently, after completion of such preheating operation, remelting/hardening treatment for the cam surface 5 within the range from the melting operation start position M1 to the melting operation end position M2 is carried out in the same manner as mentioned above.

In a case where the measured temperature T is lower than 150° C., intensity of electricity required for preheating by the torch 40 may be adjusted depending on such measured temperature T, provided that the preheating range is kept constant. Alternatively, both the preheating range and intensity of the electricity required for the preheating operation may adequately be adjusted depending on the measured temperature T.

Figure 9:
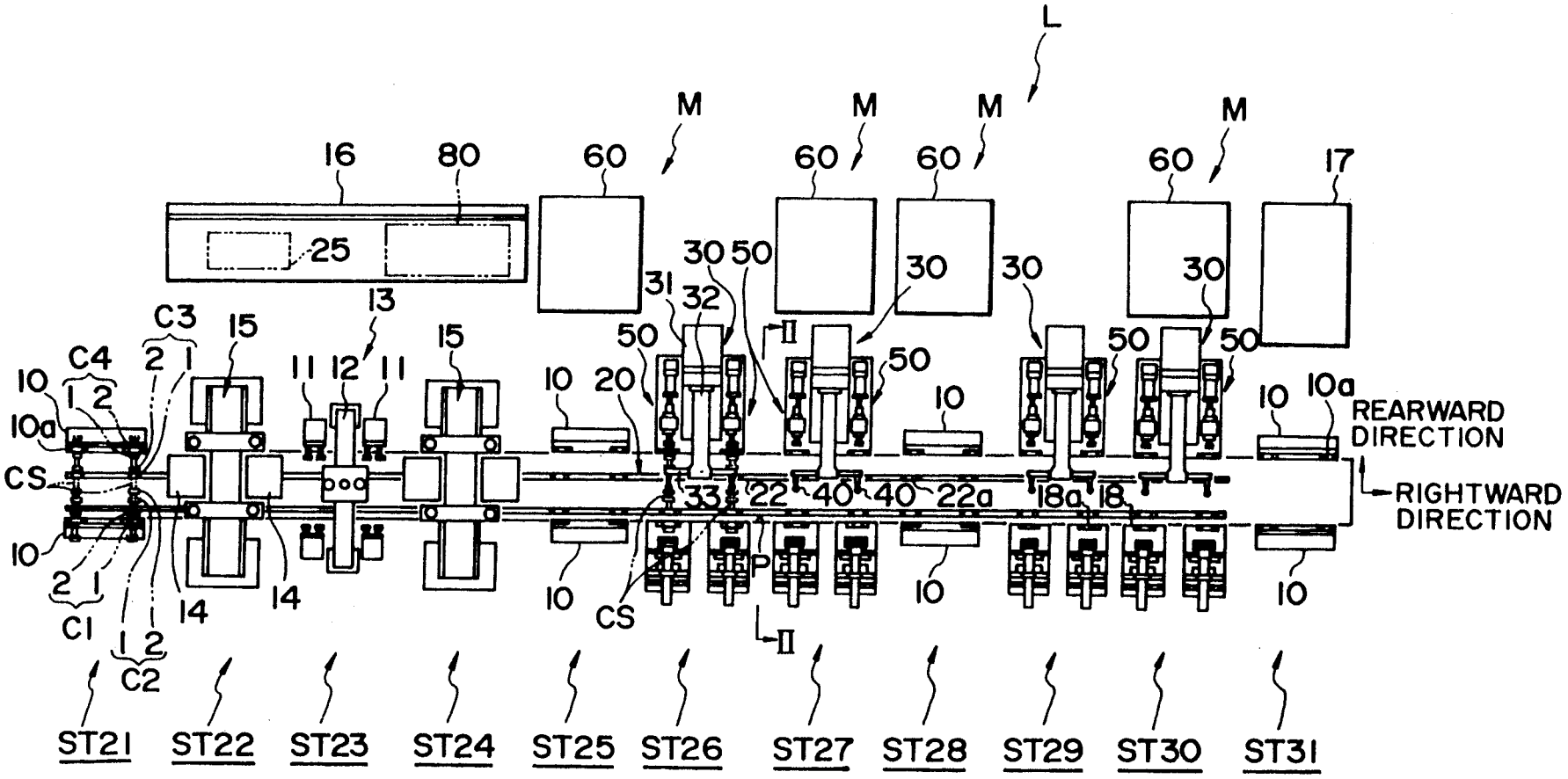
FIG. 9 is a plan view which schematically illustrates the structure of a remelting/hardening treatment line in accordance with a second embodiment of the present invention.

FIG. 9 is a plan view which schematically illustrates the structure of a remelting/hardening treatment line L in accordance with a second embodiment of the present invention. This remelting/hardening treatment line L is substantially the same as that of FIG. 1 with respect to structure and function of each of respective stations thereof. According to the second embodiment of the present invention, a cam shaft receiving station ST21, a first preheating station ST22, a vehicle type discriminating station ST23, a second preheating station ST24, a first waiting station ST25, a first treatment station ST26, a second treatment station ST27, a second waiting station ST28, a third treatment station ST29, a fourth treatment station ST30 and a cam shaft discharging station ST31 are arranged one after another in such order from the left-hand side as seen in FIG. 9. A pit P is recessed in a floor F across the respective stations ST21 to ST31 while extending in the leftward/rightward direction as seen in FIG. 9. An opposed pair of work receiving members 10 are arranged peripheral to the pit P in each of the cam shaft receiving station ST21, the first and second waiting stations ST25 and ST28 and the cam shaft discharging station ST31 in the same manner as the remelting/hardening treatment line L in accordance with the first embodiment of the present invention. A vehicle type discriminating unit 13 composed of an opposed pair of supporting mechanisms 11 and an opposed pair of vehicle type discriminating mechanisms 12 is arranged in the vehicle type discriminating station ST23. In addition, a preheating unit 15 including an opposed pair of preheaters 14 is arranged in each of the first and second preheating stations ST22 and ST24. Additionally, a torch displacing/driving unit 30, an opposed pair of TIG torches 40 and an opposed pair of rotational supporting units 50 are arranged in each of the first treatment station ST26, the second treatment station ST27, the third treatment station ST29 and the fourth treatment station ST30. Also in the second embodiment, a remelting/hardening treatment apparatus M is constructed in the same manner as that in accordance with the first embodiment of the present invention, and moreover, exhibits the same functional effects as those obtained in accordance with the first embodiment of the present invention.

It should of course be understood that the present invention can be applied to remelting/hardening treatment for various types of products other than the cam shafts CS, that the remelting/hardening treatment apparatus M which has been described above in conjunction with the first and second embodiments of the present invention is merely illustrative, and that the present invention can be applied to a remelting/hardening treatment methods employable by using other various types of remelting/hardening apparatuses without departure from the scope of the invention as defined by the appended claims.

What is claimed is:

1. In a method of conducting a remelting/hardening treatment of a first part of a work, said method including subjecting said work to an initial preheating operation to cause said first part of said work to be at a temperature within a particular temperature range, and then subjecting said first part of said work to remelting and hardening by heating said first part of said work by a torch, the improvement comprising:

prior to said subjecting said first part of said work to said remelting and hardening, measuring the temperature of said first part of said work and determining whether or not said measured temperature is within said particular temperature range;

is said measured temperature is within said particular temperature range, then subjecting said first part of said work to said remelting and hardening; and if said measured temperature is lower than a lower limit temperature of said particular temperature range, performing an additional preheating operation by heating a second part of said work by said torch, thereby raising the temperature of said first part of said work to be within said particular temperature range, and then subjecting said first part of said work to said remelting and hardening.

2. The improvement claimed in claim 1, further comprising, after performing said initial preheating operation, firmly positioning said work in position in a remelting/hardening treatment apparatus including said torch.

3. The improvement claimed in claim 1, wherein said work is an engine cam shaft having spaced axially therealong plural cams.

4. The improvement claimed in claim 3, wherein said first part of said work comprises a valve driving surface of each of said cams.

5. The improvement claimed in claim 4, wherein said second part of said work comprises a partial cylindrical surface of each of said cams.

6. The improvement claimed in claim 5, wherein said particular temperature range is 150°–400° C.

7. The improvement claimed in claim 6, comprising, when said measured temperature is within a range of 100°–150° C., heating said partial cylindrical surface over an angular extent thereof of 40° from a preheating operation start position.

8. The improvement claimed in claim 6, comprising, when said measured temperature is below 100° C., heating said partial cylindrical surface over an angular extent thereof of 65° from a preheating operation start position.

9. The improvement claimed in claim 1, wherein said particular temperature range is 150°–400° C., and comprising heating said second part of said work over a greater area thereof when said measured temperature is below 100° C. than when said measured temperature is within a range of 100°–150° C.

10. The improvement claimed in claim 1, comprising heating said second part of said work over a greater area thereof the more said measured temperature is below said particular temperature range.

11. The improvement claimed in claim 1, wherein said torch is a TIG torch.

12. The improvement claimed in claim 1, wherein said additional preheating operation is performed by operating said torch at a level of output that is lower than a level of output thereof when said torch is operated to perform said remelting and hardening.

13. The improvement claimed in claim 12, wherein said level of output of said torch during said additional preheating operation is approximately 20–50% of said level of output of said torch during said remelting and hardening.

14. The improvement claimed in claim 1, further comprising, prior to performing said additional preheating operation, determining based on said measured temperature at least one of a level of output of said torch and a length of time of said additional preheating operation necessary for said additional preheating.

15. The improvement claimed in claim 1, comprising continuously transferring said torch along a surface of said second part of said work during said additional preheating operation, and, after completion of said additional preheating operation, continuously conveying said torch from said second part of said work to said first part of said work.

16. In a method of conducting a remelting/hardening treatment of a valve driving surface of each of a plurality of cams that have respective partial cylindrical surfaces and that are spaced along a cam shaft, said method including subjecting said cam shaft to an initial preheating operation to cause each said valve driving surface to be at a temperature within a particular temperature range of 150°–400° C., firmly placing said cam shaft in position in a remelting/hardening treatment apparatus including a TIG torch, and then subjecting said valve driving surface of each of said cams to remelting and hardening by heating said valve driving surface by said torch, the improvement comprising:

prior to said subjecting said valve driving surface to said remelting and hardening, measuring the temperature of said valve driving surface and determining whether or not said measured temperature is within said particular temperature range;

if said measured temperature is within said particular temperature range, then subjecting said valve driving surface to said remelting and hardening;

if said measured temperature is within a range of 100°–150° C.:

lowering a level of output of said TIG torch to be within a range of approximately 20–50% of a level of output thereof when said TIG torch is operated to perform said remelting and hardening;

performing an additional preheating operation by heating said partial cylindrical surface over an angular extent thereof of 40° from a preheating operation start position by said TIG torch, thereby raising the temperature of said valve driving surface to be within said particular temperature range; and then subjecting said valve driving surface to said remelting and hardening; and if said measured temperature is below 100° C.:

lowering said level of output of said TIG torch to be within said range of approximately 20–50% of said level of output thereof when said TIG torch is operated to perform said remelting and hardening;

performing an additional preheating operation by heating said partial cylindrical surface over an angular extent thereof of 65° from said preheating operation start position by said TIG torch, thereby raising the temperature of said valve driving surface to be within said particular temperature range; and then subjecting said valve driving surface to said remelting and hardening.

* * * * *